United States Patent [19]

Romer et al.

[11] 4,362,107

[45] Dec. 7, 1982

[54] PRACTICE PROJECTILE

[75] Inventors: Rudolf Romer, Kaarst; Christian Jaeneke; Günter Sikorski, both of Duesseldorf, all of Fed. Rep. of Germany

[73] Assignee: Rheinmetall GmbH, Duesseldorf, Fed. Rep. of Germany

[21] Appl. No.: 84,758

[22] Filed: Oct. 15, 1979

[30] Foreign Application Priority Data

Oct. 14, 1978 [DE] Fed. Rep. of Germany ..... 2844870

[51] Int. Cl.[3] ..... F42B 13/16

[52] U.S. Cl. ..... 102/520; 102/444; 102/517; 102/529

[58] Field of Search ..... 102/529, 501, 498, 441, 102/444, 520–523, 517, 703

[56] References Cited

U.S. PATENT DOCUMENTS

| | | | |
|---|---|---|---|
| 3,667,395 | 6/1972 | Romer et al. | 102/529 |
| 3,898,933 | 8/1975 | Castera et al. | 102/529 |
| 4,109,579 | 8/1978 | Carter | 102/529 |
| 4,140,061 | 2/1979 | Campoli | 102/529 |
| 4,195,573 | 4/1980 | Leeker et al. . | |
| 4,215,632 | 8/1980 | Sie | 102/529 |
| 4,220,092 | 9/1980 | Smith et al. | 102/529 |
| 4,242,960 | 1/1981 | Boeder et al. | 102/529 |

*Primary Examiner*—Harold J. Tudor

[57] ABSTRACT

Practice projectile for target practice, which corresponds in shape and weight to a normal combat projectile, particularly to a sub-caliber combat projectile. The projectile upon impact disintegrates at preset breaking points. The projectile is unitary, but has at least one preset breaking point along its length. The projectile may be constructed as a tail-stabilized arrow-shaped projectile with a propulsive sabot extending over the preset breaking line and the preset breaking line may be positioned in the zone of the minimum firing loading.

4 Claims, 3 Drawing Figures

PRACTICE PROJECTILE

BACKGROUND OF THE INVENTION

The invention relates to a practice projectile for target practice, which corresponds in shape and weight to a normal combat projectile, particularly to a sub-caliber combat projectile, and which upon impact disintegrates at preset breaking points.

Practice projectiles for target practice are used for the training of soldiers in the use of a firearm and should therefore reproduce the properties of normal combat projectiles as accurately as possible, if they are to serve their purpose as regards training. This applies both to the external ballistics by which the trainee's acquisition of the aiming reflexes, and any necessary correction reflexes are governed and to the operation and use of the weapon. At present the training of soldiers in the use of firearms is carried out to the maximum range of the type of weapon in use. It is true that the firing is usually effected at an angle of elevation which does not provide the maximum range, but there is a possibility that the shot will ricochet, thus reaching a distance almost equal to the maximum range. This applies in particular to sub-caliber combat projectiles constructed as "weight" projectiles for tank-carried guns. The corresponding practice ammunition in such cases is modified in the manner required to ensure that after the combat distance has been exceeded the projectile is strongly braked by acrodynamic measures; a limited safety range on both sides is required; however, since the practice projectile lands flat on hard ground at a short distance it is likely to ricochet in the transverse direction with energy which is hardly reduced at all and must nevertheless be prevented from going beyond the safety margin.

German Exam. Patent application 23 09 589 (which corresponds to U.S. Pat. No. 3,898,933) describes a practice projectile of the type described hereinbefore, designed for subcaliber ammunition contained in a cartridge. This practice projectile is required to disintegrate both when hitting the target, without destroying the latter, and when landing flat on the ground. It consists of a metallic projectile casing with a filling of powder mixed with a polymerizable product, the dimensions required for the metal projectile casing being such that the preset breaking line, upon the impact of the practice projectile, takes the form of a tapering breaking zone positioned radially of the pulverous filling compound which thereafter emerges. The construction of the known practice projectile is relatively complicated, so that it is expensive to manufacture. Furthermore, it is not immediately clear how a preset breaking line can be provided which will stand up to the stresses undergone by it when the projectile is being fired and also during its flight and nevertheless will cause the projectile to disintegrate as soon as it makes impact on the hard ground; this is particularly true, since the projectile is also required to disintegrate by itself without causing damage to the actual practice target upon impact thereon.

SUMMARY OF THE INVENTION

The purpose of the present invention is to provide a practice projectile of the type indicated above, for target practice, which will be particularly suitable as a tail-stabilized sub-caliber projectile, simple to construct and manufacture and thus available as an economical practice projectile, and which can be relied upon to disintegrate on impact at a narrow angle with respect to the ground, its effect on the actual target being of secondary importance.

These objects are achieved by the projectile on the invention. Such projectile corresponds in shape and weight to a normal combat projectile, particularly to a sub-caliber combat projectile, and upon impact disintegrates at least along one preset breaking line along its length. The breaking line may consist of a breaking notch when the projectile is of integral construction. When the projectile is two-part in construction, a screw-threaded collar or a screw-threaded pin serves as a connecting element and preset breaking line. The projectile may be constructed as a tail-stabilized arrow-shaped projectile with a propulsive cage (sabot) extending over the preset breaking line.

The preset breaking line may be positioned in the zone of the minimum firing loading.

The propulsive cage sabot may be affixed to the projectile by means of interfitting splines and grooves system and the preset breaking line, as viewed in the direction of flight, may precede the rear groove of the system by a distance corresponding to about twice the diameter of the projectile.

The practice projectile of the invention is characterized by the fact that it completely corresponds to the normal combat projectile as regards shape, dimensions, weight and thus external ballistic properties, although the material of the projectile need not satisfy the same requirements as that of an actual combat projectile, production costs thus being reduced. As the projectile to which the invention relates completely corresponds to the normal combat projectile except for the material, the shape of the tail and the preset breaking points provided on the projectile, the practice projectile can be manufactured in the same manner and with the same machinery as the combat projectile. This considerably reduces the cost of manufacture of the practice projectile, particularly since when it is constructed as a tail stabilized sub-caliber projectile the sabot used can likewise be identically similar to that of the combat projectile.

BRIEF DESCRIPTION OF THE DRAWINGS

Further details and advantages of the invention will emerge from the following description of a number of examples shown in the drawing, in which.

DETAILED DESCRIPTION

Figure 1:
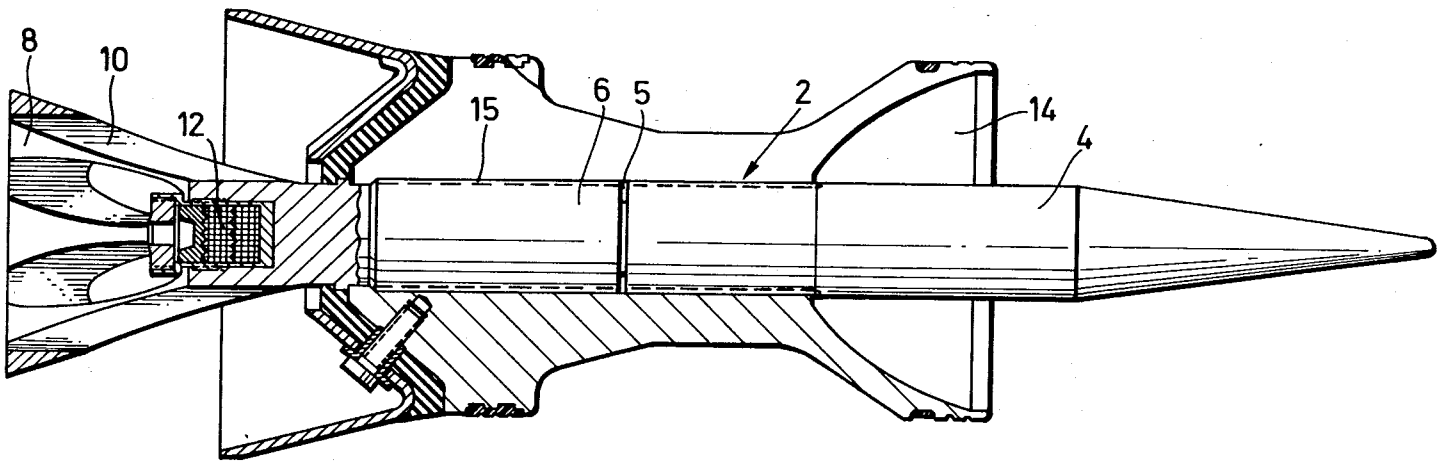
FIG. 1 is a view in axial section through a first version of the practice projectile according to the invention.

In the first embodiment of the practice projectile according to the invention, illustrated in FIG. 1, the projectile 2 is made in one piece and consists of a point 4 and a tail 6.

Between parts 4 and 6 of the projectile there is an annular notch or groove 5 representing the preset breaking points at which the point 4 of the projectile and the tail 6 of the projectile separate from each other in the event of impact of the protectile on the ground or some other obstacle. The depth of the notch or groove 5 is selected accordingly, A conical tail 8 with axial bores 10 is attached to the rear of the projectile 2. This conical tail 8 stabilizes the projectile 2 as a result of its flow resistance, which increases considerably below a certain Mach number, so that the projectile 2 is strongly braked after a certain period of flight, when the velocity has fallen below the aforementioned Mach number, the range of the projectile thus being reduced in comparison with that of an actual combat projectile. Within the range for practice firing this braking effect of the tail 8 does not yet occur, so that the practice projectile 2 has the same external ballistic properties, when used for practice, as the corresponding normal combat projectile. A tracer compound 12 is provided in the rear part of the projectile 2 so that the said projectile 2 can be followed up in the course of its flight.

A sabot 14 is connected to the point and rear part of the projectile by means of a teeth (spline and groove) system 15; the structure of the sabot 14 and its interaction with the projectile 2 do not form the subject ot the present invention and will therefore not be described in detail. The sabot cage 14 corresponds to that shown in German Pat. No. 1,703,507 (corresponding to U.S. Pat. No. 3,620,167) and German Pat. No. 2,236,142.

The acceleration forces are transmitted through the sabot 14 to the projectile 2, partly as thrust forces and partly as tractive forces. The point 4 of the projectile undergoes thrust forces while the rear part 6 of the projectile is accelerated by tractive forces.

Between the two there is a certain minimum stress zone in which the notch or groove 5 is situated and the position of which precedes the rear toothed groove between the sabot 14 and the projectile 2, by a distance corresponding to about twice the diameter of the projectile. As the sabot 14 extends over the preset breaking line and this latter is positioned within the "stress minimum", the said preset breaking line is practically free of "firing stresses", so that the said preset breaking line cannot be broken by the said "firing stresses".

Figure 2:
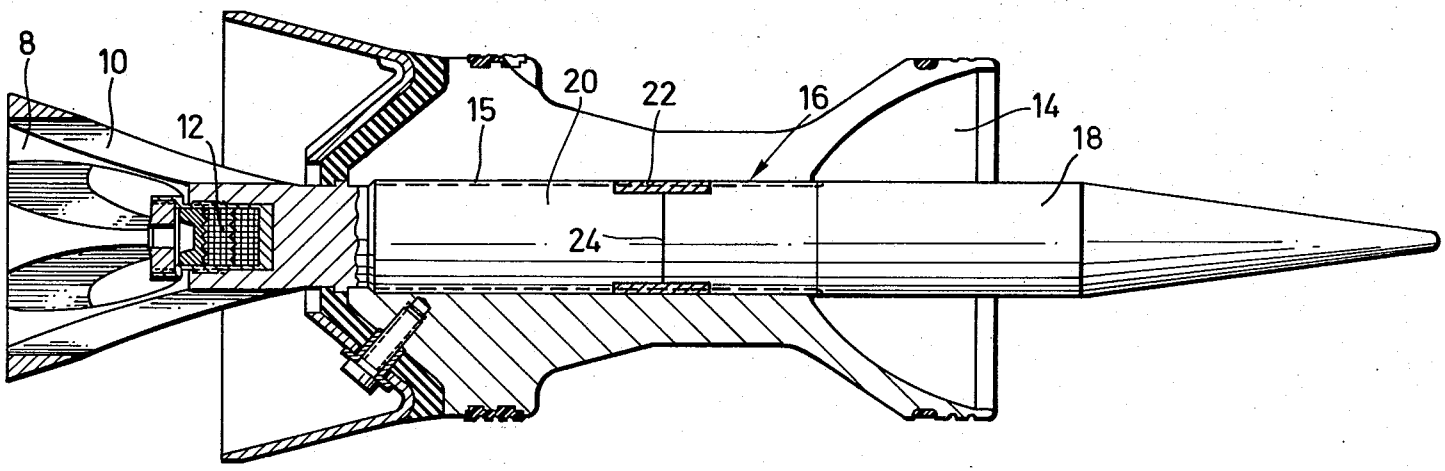
FIG. 2 is a similar view of a second version of the practice projectile according to the invention.
Figure 3:
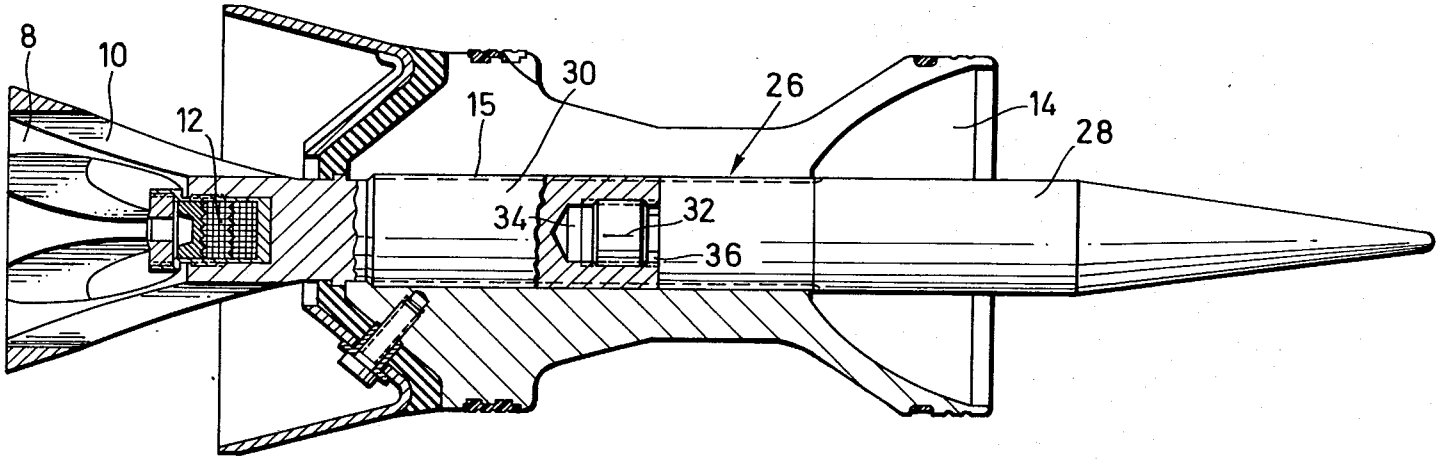
FIG. 3 is a similar view of a third version of the practice projectile according to the invention.

The embodiments shown in FIGS. 2 and 3 differ from that shown in FIG. 1 by the construction of the preset breaking line, so that the same reference numbers are used in FIGS. 2 and 3 for the same parts as those in FIG. 1.

The embodiments shown in FIG. 2 has a projectile 16 which is constructed in two parts and has a point 18 and a rear part 20. The said parts 18 and 20 of the projectile are interconnected by a screw-threaded collar 22 the dimensions of which are selected to ensure that it forms the preset breaking point in the zone of the separating joint 24 between the parts 18 and 20 of the projectile.

The projectile 26 shown in FIG. 3 is likewise constructed in two parts, a screw-threaded pin 32 being provided at the point 28 of the projectile and screwed into a corresponding bore 34 of the rear part 30 of the projectile. A notch or groove 36 provided between the screw-threaded pin 32 and the point 28 of the projectile forms the preset breaking line in this embodiment. This example likewise is identically similar as regards its further elements to the practice projectile shown in FIG. 1, so that the said elements are not described in detail.

In the versions shown in FIGS. 2 and 3 the parts 18 and 28 respectively, can be made of a different material from the rear parts 20 and 30, respectively, of the projectile, so that the practice projectile in question, by the selection of suitable materials, can be easily adapted to the external ballistic properties of the normal combat projectile.

Although the invention is illustrated and described in reference to a plurality of preferred embodiments thereof, it is to be expressly understood that it is in no way limited to the disclosure of such a plurality of preferred embodiments but is capable of numerous modifications within the scope of the appended claims.

I claim:

1. A tail-stabilized subcaliber non-detonating projectile for target practice having a sabot operatively mounted thereon, adapted to remain intact until impact practice, comprising in combination, (a) a casing which corresponds in weight and shape to a normal subcaliber projectile, said casing having at least one preset breaking line;

(b) said sabot being mounted over said preset breaking line;

(c) said preset breaking line being disposed in the zone of minimum firing loading upon the projectile casing;

(d) said sabot being mounted on the projectile by means of an interfitting splines and grooves system, said preset breaking line being disposed in front of the rearmost extent of said interfitting splines and grooves system relative to the direction of flight of said projectile by a distance corresponding to about twice the diameter of the projectile, whereby upon impact the projectile disintegrates at said preset breaking line.

2. A sub-caliber practice projectile in accordance with claim 1, wherein the casing is made in one piece, and the breaking point comprises a notch in the casing.

3. A sub-caliber practice projectile in accordance with claim 1, wherein the casing is made in two parts and comprising a screw-threaded collar serving as a connecting element between the casing parts and the preset breaking line.

4. A sub-caliber practice projectile in accordance with claim 1, wherein the casing is made in two parts and comprising a screw-threaded pin serving as the connecting element between the casing parts and the preset breaking line.

* * * * *